US010571134B2

(12) United States Patent
Weaver

(10) Patent No.: US 10,571,134 B2
(45) Date of Patent: Feb. 25, 2020

(54) OVEN APPLIANCE WITH DUAL OPENING DOORS

(71) Applicant: Haier US Appliance Solutions, Inc., Wilmington, DE (US)

(72) Inventor: Mark Aaron Weaver, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 148 days.

(21) Appl. No.: 15/798,547

(22) Filed: Oct. 31, 2017

(65) Prior Publication Data

US 2019/0128532 A1 May 2, 2019

(51) Int. Cl.
*F24C 15/02* (2006.01)

(52) U.S. Cl.
CPC ..... *F24C 15/023* (2013.01)

(58) Field of Classification Search
CPC ..... F24C 15/02; F24C 15/022; F24C 15/023; E05Y 2900/132; Y10S 292/12; F27D 1/1858; F27D 1/1808; F27D 1/18
See application file for complete search history.

(56) References Cited

U.S. PATENT DOCUMENTS 1,388,533 A * 8/1921 Van Horn ..... E05F 13/02 235/94 A
1,867,589 A * 7/1932 Phillips ..... E05C 17/40 292/263
1,875,873 A * 9/1932 Johnson ..... E05F 17/004 292/278
2,465,555 A * 3/1949 Smith ..... E05F 17/004 312/275
2,953,419 A * 9/1960 Ingolia ..... F24C 15/02 126/190
3,017,926 A * 1/1962 Kauppila ..... E05D 15/264 160/213
3,655,942 A * 4/1972 Tomsic ..... A47J 37/0635 219/399
5,061,022 A * 10/1991 Meriwether ..... E05C 7/04 292/33
6,742,302 B2 * 6/2004 Karkkainen ..... E05F 5/12 49/103
8,510,991 B2 8/2013 Collene
9,814,311 B2 * 11/2017 Mueller ..... A47B 81/00

FOREIGN PATENT DOCUMENTS

CN 101498465 A 8/2009
KR 20030093872 A 12/2003

* cited by examiner

*Primary Examiner* — Gregory A Wilson
(74) *Attorney, Agent, or Firm* — Dority & Manning, P.A.

(57) ABSTRACT

An oven appliance includes a cabinet having a chamber defined therein. The chamber is accessible through an opening. The oven appliance also includes a first door having a first side and a second side. The first side of the first door is rotatably mounted to one side of the cabinet proximate the opening. A second door includes a first side and a second side. The first side of the second door is rotatably connected to the second side of the first door by a hinge comprising a pivot. The first door and the second door are movable between an open position and a closed position to selectively sealingly enclose the chamber. The first door and the second door define a gap therebetween in the closed position.

18 Claims, 6 Drawing Sheets

OVEN APPLIANCE WITH DUAL OPENING DOORS

FIELD OF THE INVENTION

The present subject matter relates generally to oven appliances, such as French door oven appliances.

BACKGROUND OF THE INVENTION

Oven appliances generally include a cabinet that defines a cooking chamber for receipt of food articles for cooking and an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

Certain French door oven appliances include a linkage assembly that connects the oven appliance's pair of doors such that the doors open and close simultaneously. Such linkage assemblies can be complex, requiring several constituent components, which may take up significant volume within the cabinet of the oven appliance. Also, simultaneous opening French doors may expose a hot interior surface of the doors when the doors are opened.

Accordingly, an oven appliance with features for improving access to the cooking chamber would be useful.

BRIEF DESCRIPTION OF THE INVENTION

The present invention provides bi-fold French doors for an oven which promote ease of access to the cooking chamber of the oven as well as a slidable rack therein, and are structurally simple with a minimal number of moving parts. Additional aspects and advantages of the invention will be set forth in part in the following description, or may be apparent from the description, or may be learned through practice of the invention.

In one exemplary embodiment, an oven appliance is provided. The oven appliance includes a cabinet that defines a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The chamber is accessible through an opening defined in the front portion of the cabinet. The oven appliance also includes a heating element for providing heat to the chamber of the cabinet. The oven appliance also includes a first door having a first side and a second side. The first side of the first door is rotatably mounted to one of the left side and the right side of the cabinet proximate the opening. A second door is provided, the second door including a first side and a second side. The first side of the second door is rotatably connected to the second side of the first door by a hinge comprising a pivot. The first door and the second door are movable between an open position and a closed position to selectively sealingly enclose the chamber. The first door and the second door each extend along the lateral direction and define a lateral gap therebetween in the closed position.

In another exemplary embodiment, an oven appliance is provided. The oven appliance includes a cabinet that defines a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The chamber is accessible through an opening defined in the front portion of the cabinet. The oven appliance also includes a heating element for providing heat to the chamber of the cabinet. The oven appliance also includes a first door having a first side and a second side. The first side of the first door is rotatably mounted to one of the left side and the right side of the cabinet proximate the opening. A second door is provided, the second door including a first side and a second side. The first side of the second door is rotatably connected to the second side of the first door by a hinge comprising a pivot. The first door and the second door are movable between an open position and a closed position to selectively sealingly enclose the chamber. The first door and the second door each extend along the lateral direction and define a lateral gap therebetween in the closed position. The oven appliance also includes a link arm comprising a first end rotatably connected to the cabinet proximate the opening and a second end rotatably connected to one of the first door and the second door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
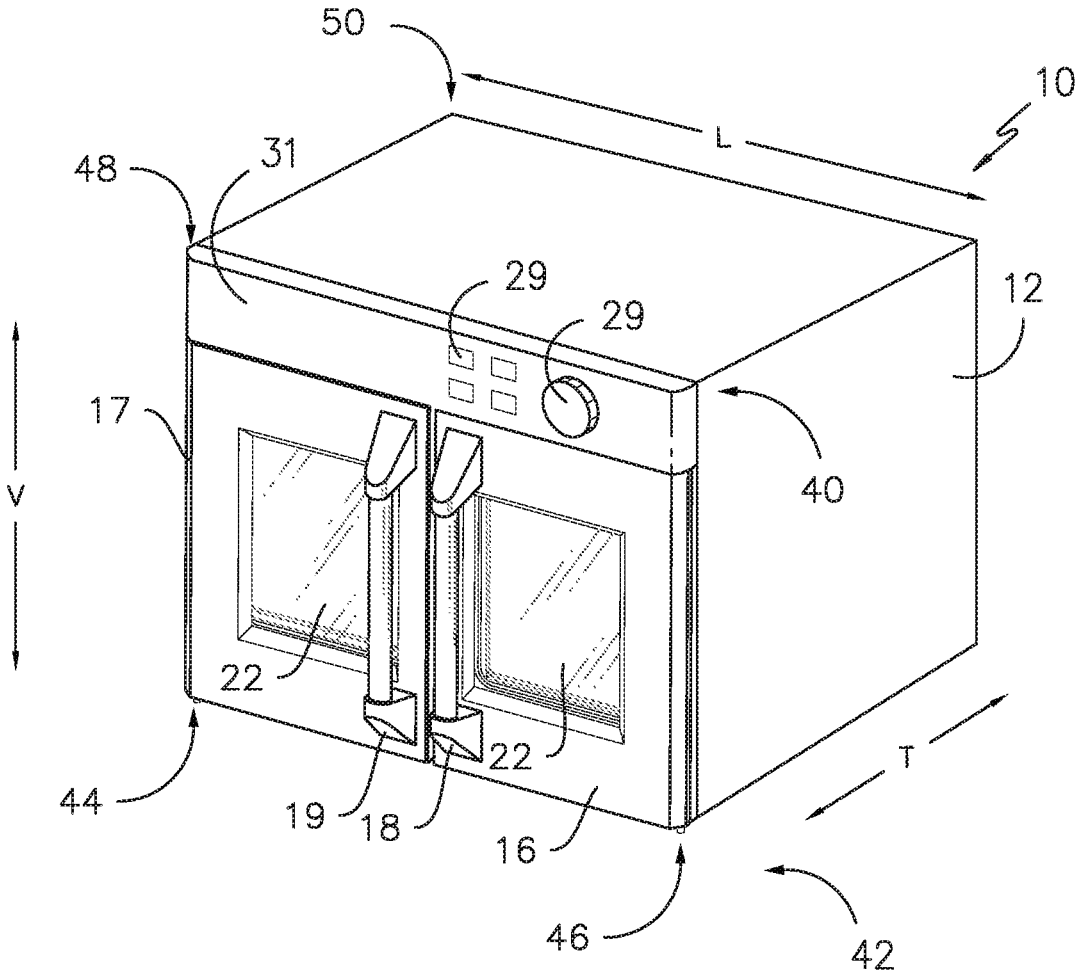
FIG. 1 provides a perspective view of an oven appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
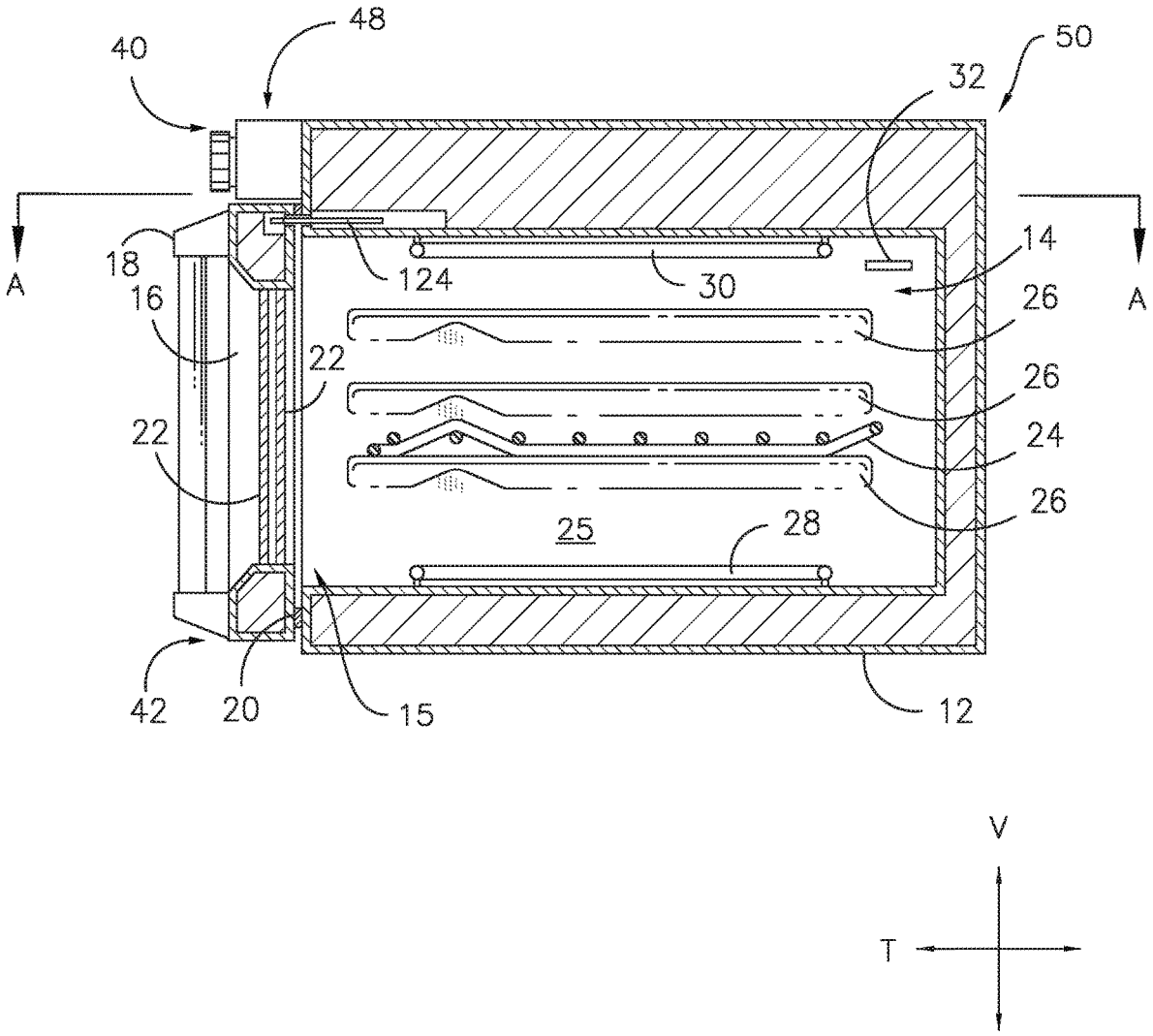
FIG. 2 provides a side section view of the exemplary oven appliance of FIG. 1.

FIGS. 1 and 2 illustrate an oven appliance 10 according to an exemplary embodiment of the present subject matter. Oven appliance 10 includes an insulated cabinet 12 which defines a vertical direction V, a lateral direction L and a transverse direction T. The vertical, lateral, and transverse directions V, L, and T are mutually perpendicular and form an orthogonal direction system. Cabinet 12 extends between a top portion 40 and a bottom portion 42 along the vertical direction V. Cabinet 12 extends between a left side 44 and a right side 46 along the lateral direction L and between a front portion 48 and a back portion 50 along the transverse direction T.

Figure 3:
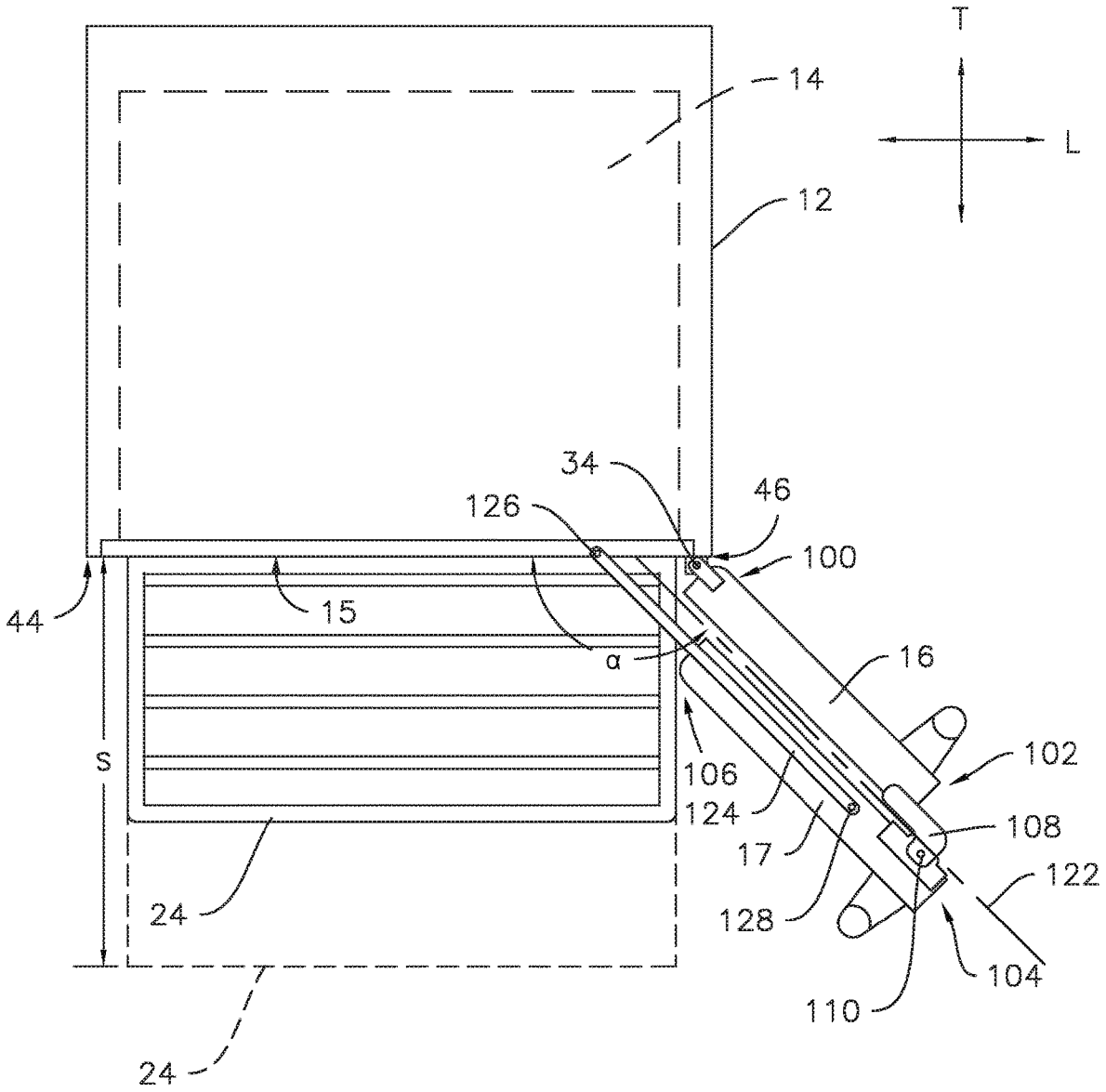
FIG. 3 provides a top section view of the exemplary oven appliance of FIG. 1 taken along line A-A with the first door and the second door in an open position.
Figure 4:
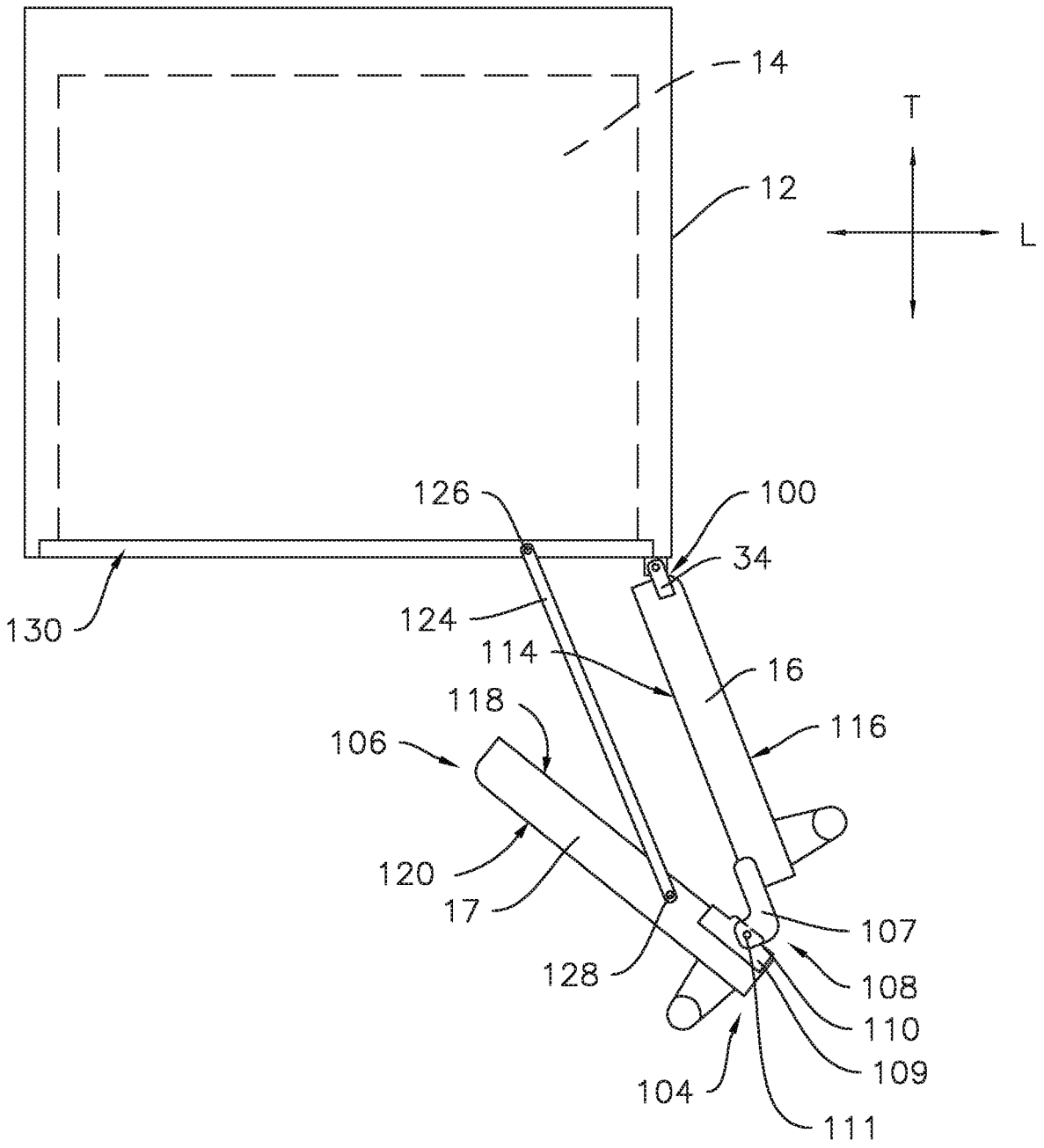
FIG. 4 provides a top section view of the exemplary oven appliance of FIG. 1 taken along line A-A with the first door and the second door in an intermediate position.
Figure 5:
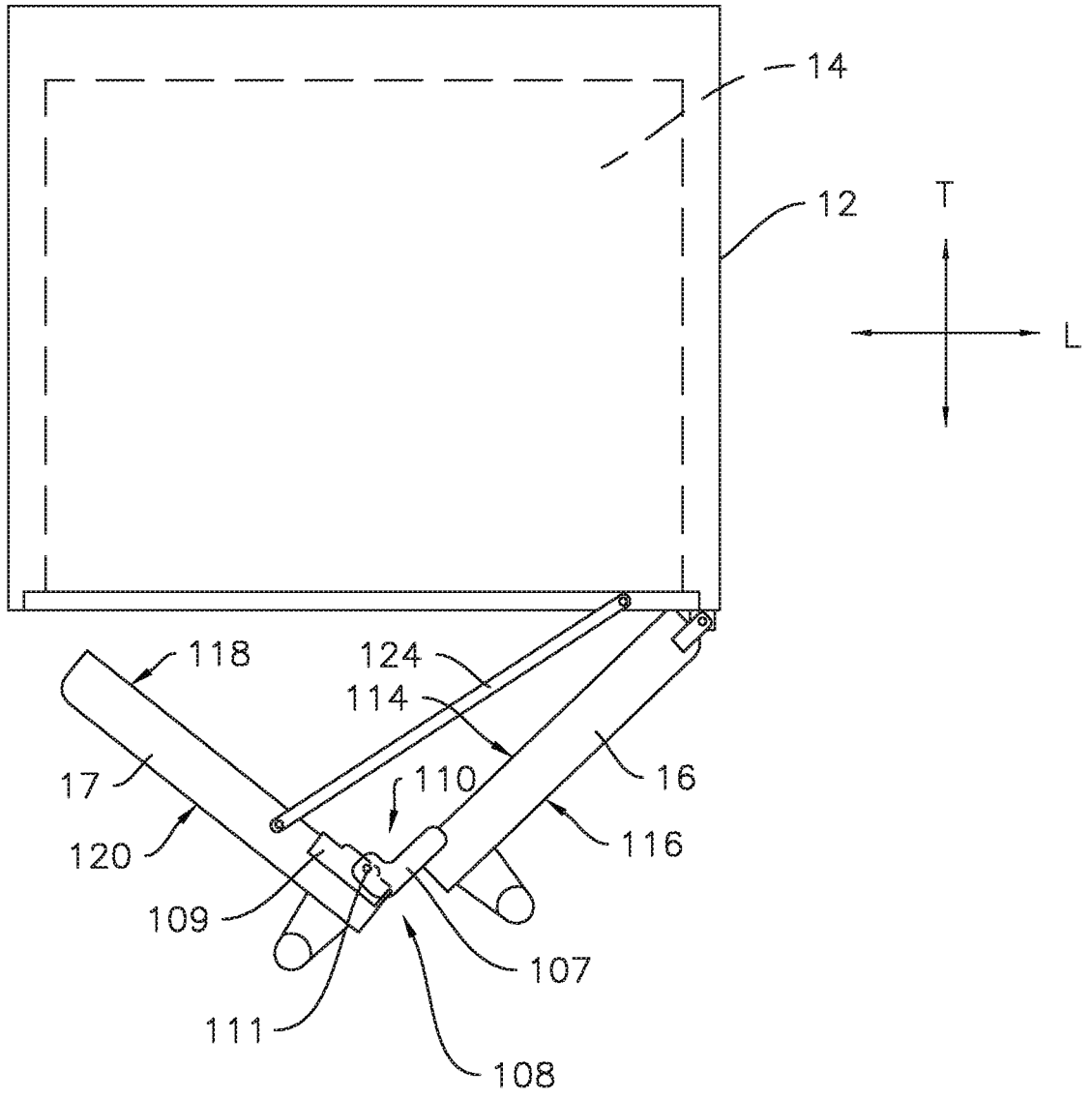
FIG. 5 provides a top section view of the exemplary oven appliance of FIG. 1 taken along line A-A with the first door and the second door in another intermediate position.

Cabinet 12 includes an interior surface 25 that defines a cooking chamber 14. Cooking chamber 14 is configured for the receipt of one or more food items to be cooked. Oven appliance 10 also includes a first door 16 and a second door 17 rotatably mounted on cabinet 12 at the front portion 48 of cabinet 12 proximate an opening 15 to chamber 14, the opening 15 formed in the front portion 48. Thus, oven appliance 10 is sometimes referred to as a French door style oven appliance. Doors 16, 17 are configured for selectively shifting between a closed position or configuration as shown in FIGS. 1 and 2 in which the user is impeded from accessing cooking chamber 14 by doors 16, 17 and an open position or configuration as shown in FIG. 3 in which a user can access cooking chamber 14. A first handle 18 and a second handle 19 are attached to first door 16 and second door 17, respectively. Handles 18, 19 assist with shifting doors 16, 17 between the open and closed positions. Glass panes 22 provide for viewing the contents of chamber 14 when doors 16, 17 are in the closed position as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16, 17 are open. Multiple rails 26 are provided so that the height of rack 24 may be adjusted.

Heating elements 28 and 30 are positioned within the chamber 14 of cabinet 12. Heating elements 28 and 30 are used to heat chamber 14 for both cooking, e.g., food items, and cleaning of oven appliance 10. While electrically-resistive heating elements 28 and 30 are shown, the present invention may be used with other heating elements as well such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors 32 could be placed into oven appliance 10 for determining the oven temperature.

The arrangement of oven appliance 10 is provided by way of example only and is not intended to limit the present subject matter in any aspect. The present subject matter can be used with other oven configurations as well. For example, the present subject matter may be used with an oven appliance that defines multiple interior cavities for the receipt of food and/or has different pan or rack arrangements than what is shown in FIG. 2. Heating elements at the top, back, or sides of chamber 14 may also be provided, and a variety of different types of heating elements such as microwave, halogen, gas fuel, electrical resistance, and combinations thereof may be used. Other configurations may also be used as will be understood by one of skill in the art using the teachings disclosed herein.

Figure 6:
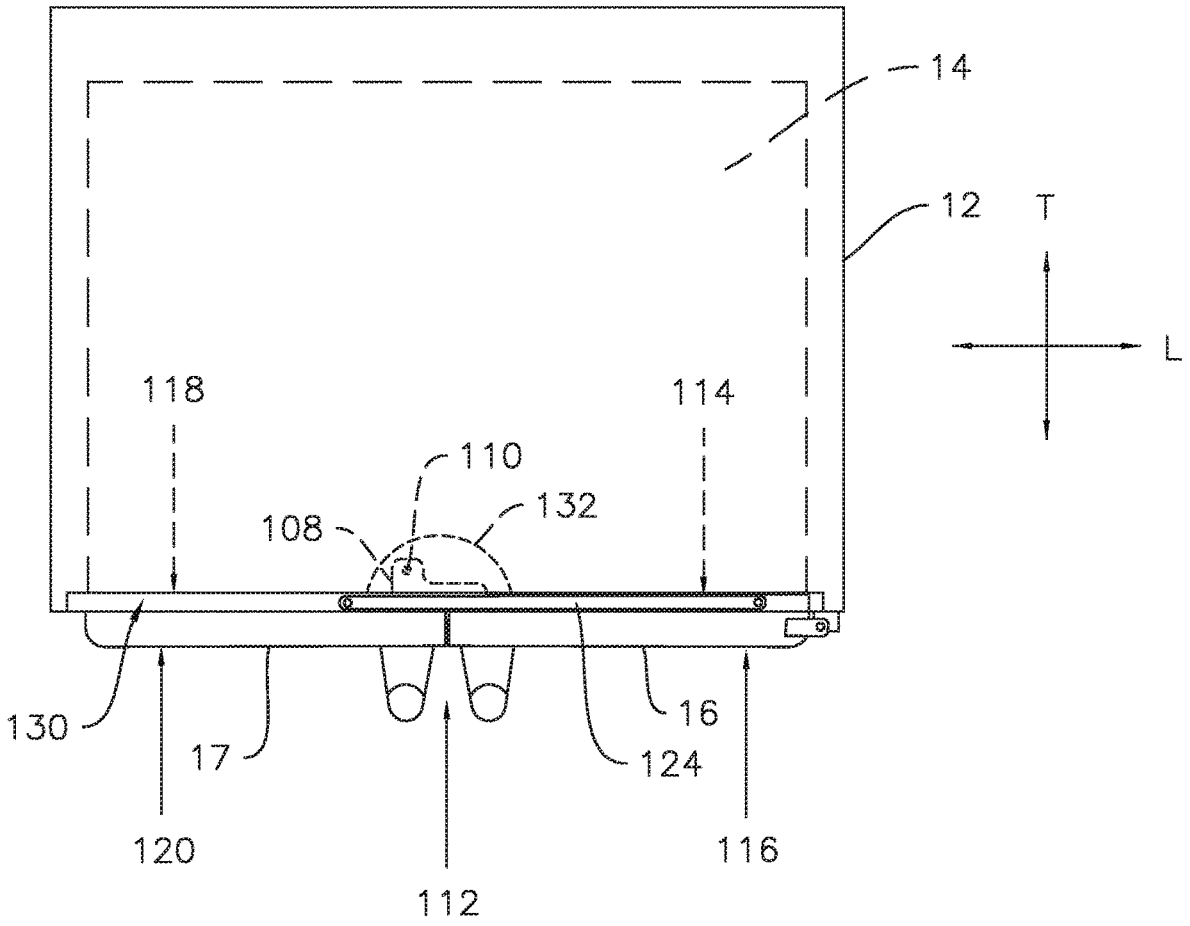
FIG. 6 provides a top section view of the exemplary oven appliance of FIG. 1 taken along line A-A with the first door and the second door in a closed position.

As illustrated in FIGS. 3 through 6, the first door 16 extends between a first side 100 and a second side 102, e.g., along the lateral direction L in the closed position (FIG. 6). The first door 16 may be rotatably mounted to one of the left side 44 and the right side 46 of the cabinet 12 proximate the opening 15. For example, in the illustrated embodiment of FIGS. 3-6, the first door 16 is rotatably mounted to the right side 46 of the cabinet 12 by a hinge 34 at the first side 100 of the first door 16. The second door 17 extends between a first side 104 and a second side 106, e.g., along the lateral direction L in the closed position (FIG. 6). The first side 104 of the second door 17 is rotatably connected to the first door 16 with a hinge 108 at the second side 102 of the first door 16. The hinge 108 includes a pivot 110. In some embodiments, the hinge 108 may include a first plate 107 mounted to the first door 16, a second plate 109 mounted to the second door 17, and a rivet 111 coupling the first plate 107 to the second plate 109. In such embodiments, the rivet 111 may define the pivot 110 of the hinge 108.

The first door 16 and the second door 17 are movable between an open position (FIG. 3) and a closed position (FIG. 6) to selectively sealingly enclose the chamber 14. Moreover, as shown, e.g., in FIGS. 4 and 5, the doors 16, 17 travel through a series of intermediate positions between the open position of FIG. 3 and the closed position of FIG. 6.

Referring now to FIG. 6 in particular, when the first door 16 and the second door 17 are in the closed position, the first door 16 and the second door 17 each extend along the lateral direction L. Also while in the closed position, the first door 16 and the second door 17 define a lateral gap 112 therebetween. In some embodiments, e.g., as illustrated in FIG. 6, the pivot 110 of the hinge 108 may be offset from the gap 112 along the lateral direction L when the first door 16 and the second door 17 are in the closed position.

As may be seen in FIGS. 3 through 6, the first door 16 includes an inner surface 114 and an outer surface 116 and the second door 17 includes an inner surface 118 and an outer surface 120. The doors 16, 17 extend between the respective surfaces 114, 116 and 118, 120. For example, as illustrated in FIG. 6, first door 16 extends between the inner surface 114 and the outer surface 116 along the transverse direction T and second door 17 extends between the inner surface 118 and the outer surface 120 along the transverse direction T when the first door 16 and the second door 17 are in the closed position.

Also illustrated in FIG. 6, the inner surface 114 of the first door 16 and the inner surface 118 of the second door 17 face the chamber 14 when the first door 16 and the second door 17 are in the closed position. Accordingly, when one or both of heating elements 28 and 30 is/are activated, the inner surfaces 114 and 118 may become hot. As shown in FIG. 3, the inner surface 118 of the second door 17 faces the inner surface 114 of the first door 16 when the first door 16 and the second door 17 are in the open position. This may advantageously prevent or minimize exposure of the inner surfaces 114 and 118, e.g., when doors 16 and 17 are opened after heating operation of the cooking appliance 10. For example, a user may access the chamber 14 to remove cooked food items therefrom after a cooking operation while the hot inner surfaces 114 and 118 are facing one another in the open position such that inadvertent contact by the user with the inner surfaces 114 and 118 may be avoided.

As illustrated in FIG. 3, the first door 16 and the second door 17 are approximately parallel when in the open position. Also, the first door 16 and the second door 17 define an angle α with the opening 15 when the first door 16 and the second door 17 are in the open position. The angle α may be defined between the opening 15 and either first door 16, second door 17, or a centerline 122 extending between and parallel to the doors 16, 17. Centerline 122 is centered between doors 16, 17, e.g., the centerline 122 is equidistantly spaced from each of the doors 16, 17. The magnitude of angle α will be the same regardless of which of the doors 16, 17 or the centerline 122 is chosen, inasmuch as doors 16, 17 and centerline 122 are all parallel. As shown, the angle α may be greater than about ninety degrees (90°) and less than about one hundred eighty degrees (180°). For example, the angle α may be between about one hundred degrees (100°) and about one hundred seventy degrees (170°), such as between about one hundred fifteen degrees (115°) and about one hundred fifty-five degrees (155°), such as about one hundred thirty five degrees (135°). As used herein, terms of approximation such as "generally," "about," or "approximately" include values within ten percent greater or less than the stated value. When used in the context of an angle or direction, such terms include within ten degrees greater or less than the stated angle or direction, e.g., "approximately parallel" includes forming an angle of up to ten degrees either clockwise or counterclockwise. Also shown in FIG. 3, the rack 24 defines a sliding path S. For example, the rack 24 may be slidably mounted in the chamber 14, e.g., on rails 26 as described above. Thus, the rack 24 may be selectively positionable in various positions along the sliding path S, such as a retracted position (FIG. 2) an intermediate position depicted in solid lines in FIG. 3, and a fully extended position depicted in dashed lines in FIG. 3. As may be seen in FIG. 3, the open position of the doors 16, 17 provides clearance for the rack 24, e.g., the first door 16 and the second door 17 are positioned outside of the sliding path S of the rack 24 when the first door 16 and the second door 17 are in the open position. For example, the angle α greater than ninety degrees may advantageously provide such clearance. Additionally, the doors 16, 17 are offset or staggered when in the open position. For example, the first side 104 of the second door 17 is offset from the second side 102 of the first door 16 when the first door 16 and the second door 17 are in the open position. The staggered configuration of the doors 16, 17 may also advantageously provide clearance for the rack 24, e.g., where the second door 17, and in particular the second side 106 thereof, is spaced apart from the opening 15 along the lateral direction L when the doors 16, 17 are in the open position.

Additionally, the opening angle α may be less than a certain amount, e.g., less than about one hundred thirty five degrees (135°), as described above. For example, in some embodiments, the oven appliance 10 may be installed next to a countertop, cabinets, or other similar kitchen furnishings (not shown). In such embodiments, the angle α being less than about one hundred thirty five degrees (135°) may advantageously avoid or minimize the doors 16, 17 and/or handles 18, 19 impacting the countertop or cabinets.

In some exemplary embodiments, the oven appliance 10 may also include a link arm 124. The link arm 124 may extend between a first end 126 and a second end 128. The first end 126 of the link arm 124 may be rotatably connected to the cabinet 12 proximate the opening 15 and the second end 128 of the link arm 124 may be rotatably connected to one of the first door 16 and the second door 17. For example, in the illustrated embodiment, the second end 128 of the link arm 124 is rotatably connected to the second door 17. In some embodiments, for example as illustrated in FIGS. 3 through 6, the link arm 124 may extend along a straight line between the first end 126 and the second end 128. In other embodiments, the link arm 124 may extend along a curved line or a dogleg. Additionally, a recess 130 may be defined in the cabinet 12 and the link arm 124 may be received within the recess 130 when the first door 16 and the second door 17 are in the closed position (FIG. 6). Also seen in FIG. 6, a second recess 132 may be defined the cabinet 12 such that at least a portion of the hinge 108 may be received in the second recess 132 when the first door 16 and the second door 17 are in the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking, the chamber being accessible through an opening defined in the front portion of the cabinet;

a heating element for providing heat to the chamber of the cabinet;

a first door comprising a first side and a second side, the first side of the first door rotatably mounted to one of the left side and the right side of the cabinet proximate the opening;

a second door comprising a first side and a second side, the first side of the second door rotatably connected to the second side of the first door by a hinge comprising a first plate mounted to the first door, a second plate mounted to the second door, and a rivet coupling the first plate to the second plate, wherein the rivet defines a pivot of the hinge, the first door and the second door movable between an open position and a closed position to selectively sealingly enclose the chamber, the first door and the second door each extending along the lateral direction and defining a lateral gap therebetween in the closed position.

2. The oven appliance of claim 1, wherein the pivot is offset from the gap along the lateral direction when the first door and the second door are in the closed position.

3. The oven appliance of claim 1, wherein the first door comprises an inner surface, the inner surface of the first door facing the chamber when the first door and the second door are in the closed position, the second door comprises an inner surface, the inner surface of the second door facing the chamber when the first door and the second door are in the closed position, and the inner surface of the second door facing the inner surface of the first door when the first door and the second door are in the open position.

4. The oven appliance of claim 1, wherein the first door and the second door define an angle with the opening when the first door and the second door are in the open position, the angle greater than about ninety degrees.

5. The oven appliance of claim 1, wherein the first door and the second door define an angle with the opening when the first door and the second door are in the open position, the angle less than about one hundred eighty degrees.

6. The oven appliance of claim 1, further comprising a link arm, a first end of the link arm rotatably connected to the cabinet proximate the opening and a second end of the link arm rotatably connected to one of the first door and the second door.

7. The oven appliance of claim 6, wherein the second end of the link arm is rotatably connected to the second door.

8. The oven appliance of claim 6, wherein the link arm extends along a straight line between the first end of the link arm and the second end of the link arm.

9. The oven appliance of claim 6, further comprising a recess defined in the cabinet, the link arm received within the recess when the first door and the second door are in the closed position.

10. The oven appliance of claim 1, further comprising a rack slidably mounted in the chamber, the rack defining a sliding path, wherein the first door and the second door are positioned outside of the sliding path of the rack when the first door and the second door are in the open position.

11. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking, the chamber being accessible through an opening defined in the front portion of the cabinet;

a heating element for providing heat to the chamber of the cabinet;

a first door comprising a first side and a second side, the first side of the first door rotatably mounted to one of the left side and the right side of the cabinet proximate the opening;

a second door comprising a first side and a second side, the first side of the second door rotatably connected to the second side of the first door by a hinge comprising a pivot, the first door and the second door movable between an open position and a closed position to selectively sealingly enclose the chamber, the first door and the second door each extending along the lateral direction and defining a lateral gap therebetween in the closed position; and a link arm comprising a first end rotatably connected to the cabinet proximate the opening and a second end rotatably connected to the second door.

12. The oven appliance of claim 11, wherein the hinge comprises a first plate mounted to the first door, a second plate mounted to the second door, and a rivet coupling the first plate to the second plate, wherein the rivet defines the pivot.

13. The oven appliance of claim 11, wherein the pivot is offset from the gap along the lateral direction when the first door and the second door are in the closed position.

14. The oven appliance of claim 11, wherein the link arm extends along a straight line between the first end of the link arm and the second end of the link arm.

15. The oven appliance of claim 11, further comprising a recess defined in the cabinet, the link arm received within the recess when the first door and the second door are in the closed position.

16. The oven appliance of claim 11, wherein the first door and the second door define an angle with the opening when the first door and the second door are in the open position, the angle greater than about ninety degrees.

17. The oven appliance of claim 11, wherein the first door and the second door define an angle with the opening when the first door and the second door are in the open position, the angle less than about one hundred eighty degrees.

18. The oven appliance of claim 11, further comprising a rack slidably mounted in the chamber, the rack defining a sliding path, wherein the first door and the second door are positioned outside of the sliding path of the rack when the first door and the second door are in the open position.

* * * * *